US008770695B2

(12) United States Patent
Murai

(10) Patent No.: US 8,770,695 B2
(45) Date of Patent: Jul. 8, 2014

(54) PRINTING APPARATUS, PRINTING METHOD, AND PROGRAM

(75) Inventor: Kiyoaki Murai, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 758 days.

(21) Appl. No.: 12/624,975

(22) Filed: Nov. 24, 2009

(65) Prior Publication Data

US 2010/0134546 A1 Jun. 3, 2010

(30) Foreign Application Priority Data

Nov. 28, 2008 (JP) ..... 2008-303764

(51) Int. Cl.
*B41J 29/38* (2006.01)

(52) U.S. Cl.
USPC ..... 347/14

(58) Field of Classification Search
USPC ..... 347/14
See application file for complete search history.

(56) References Cited

U.S. PATENT DOCUMENTS

| | | | | |
|---|---|---|---|---|
| 6,672,705 | B2 | 1/2004 | Kitahara et al. | |
| 7,198,345 | B2 | 4/2007 | Shibata et al. | |
| 7,571,982 | B2 | 8/2009 | Koase | |
| 2001/0052920 | A1 * | 12/2001 | Matsumoto et al. | 347/102 |
| 2007/0120883 | A1 * | 5/2007 | Tsuboi | 347/14 |
| 2007/0153046 | A1 * | 7/2007 | Kanematsu et al. | 347/19 |
| 2008/0068411 | A1 * | 3/2008 | Koase | 347/12 |

FOREIGN PATENT DOCUMENTS

| | | | |
|---|---|---|---|
| JP | 2002-103598 | A | 4/2002 |
| JP | 2002-292846 | A | 10/2002 |
| JP | 2005-145018 | A | 6/2005 |
| JP | 2006-326856 | A | 12/2006 |
| JP | 2007-320110 | A | 12/2007 |
| JP | 2008-094107 | A | 4/2008 |

* cited by examiner

*Primary Examiner* — Uyen Chau N Le
*Assistant Examiner* — Hoang Tran
(74) *Attorney, Agent, or Firm* — Kilpatrick Townsend & Stockton LLP

(57) ABSTRACT

A printing apparatus includes: a first head which has a plurality of nozzles arranged at a first pitch in a predetermined direction; a second head which has a plurality of nozzles arranged at a second pitch larger than the first pitch in the predetermined direction and which is spaced from the first head by a predetermined distance in a direction intersecting the predetermined direction; and a controller which controls the first and second heads so that only the first head prints the contour of a character or a line image and at least the second head prints a portion of the character or the line image other than the contour, when a print image is the character or the line image.

13 Claims, 9 Drawing Sheets

PRINTING APPARATUS, PRINTING METHOD, AND PROGRAM

This application claims priority to Japanese Patent Application No. 2008-303764, filed Nov. 28, 2008 the entirety of which is incorporated by reference herein.

BACKGROUND

1. Technical Field

The present invention relates to a printing apparatus such as an ink jet printer and a printing method.

2. Related Art

In the past, as a printing apparatus having a plurality of heads to perform printing, there were known printing apparatuses disclosed in JP-A-2007-320110, JP-A-2002-103598, and JP-A-2006-326856.

The printing apparatus disclosed in JP-A-2007-320110 includes two heads 8 and 9 for ejecting ink, as shown in FIG. 10. The heads 8 and 9 have nozzles 81 and 91, respectively. The nozzles 81 and 91 are each arranged at a predetermined pitch. The two heads 8 and 9 are disposed in two rows in a direction intersecting a transport direction of a sheet. Moreover, the pitch of the nozzles of the first row head is deviated by ½ of a predetermined pitch from the pitch of the nozzles of the second row head.

The printing apparatus disclosed in JP-A-2002-103598 includes heads for ejecting black ink, yellow ink, magenta ink, and cyan ink, respectively, and performs printing by ejecting the ink onto a print medium sequentially from the plurality of heads.

The printing apparatus disclosed in JP-A-2006-326856 includes a first row print head and a second row print head ejecting ink onto a print medium. The first row print head and the second row print head are disposed in zigzags.

In the printing apparatus disclosed in JP-A-2007-320110, however, the first row head 8 and the second row head 9 are disposed at a predetermined interval in a transport direction of a sheet. Therefore, it takes a certain time to eject ink from the nozzles 91 of the second row head 9 after the ink is ejected from the nozzles 81 of the first row head 8. For this reason, since the ink permeates into the sheet (print medium) and is dried during the certain time, it is considered that the ink is prevented from spreading. A method of disposing heater for making ink dry more rapidly between the first and second row heads may be taken into consideration.

Taking this configuration into consideration, the printing apparatus disclosed in JP-A-2007-320110 can ensure the maximum amount of ink to be ejected from the nozzles even upon performing high speed printing. Accordingly, it is possible to realize the high speed printing without deteriorating print density.

In the printing apparatus disclosed in JP-A-2007-320110, however, disposition precision of the heads 8 and 9 becomes worse as the disposition distance between the first row head 8 and the second row head 9 is larger. This is because the first row head 8 and the second row head 9 are disposed at the predetermined interval in the transport direction of the sheet. For this reason, it is necessary to make an improvement in position precision between dots of the ink ejected from the nozzles 81 of the first row head 8 and the dots of the ink ejected from the nozzles 91 of the second row head 9.

FIGS. 11A and 11B show print examples of a character printed by the printing apparatus disclosed in JP-A-2007-320110.

In FIGS. 11A and 11B, circles indicate dots formed by ejecting ink from the nozzles 81 of the head 8 and the nozzles 91 of the head 9. Numeral "1" in the circles represents the dots formed by the nozzles 81 and Numeral "3" in the circles presents the dots formed by the nozzles 91.

FIG. 11A shows a good example of the position precision of the dots fowled by ejecting the ink by the heads 8 and 9. In contrast, FIG. 11B shows a poor example of the position precision of the dots and shows that the precision of the dots of the ink cannot be ensured.

In such a circumstance, it is necessary to devise a printing apparatus capable of ensuring the position precision of the dots of ink upon printing a character or the like by a plurality of heads, while performing high speed printing.

SUMMARY

An advantage of some aspects of the invention is that it provides a printing apparatus capable of ensuring the position precision of dots of ink upon printing a character or the like, while ensuring high speed printing, when the character or the like is printed using a plurality of heads.

According to an aspect of the invention, there is provided a printing apparatus including: a first head which has a plurality of nozzles arranged at a first pitch in a predetermined direction; a second head which has a plurality of nozzles arranged at a second pitch larger than the first pitch in the predetermined direction and which is spaced from the first head by a predetermined distance in a direction intersecting the predetermined direction; and a controller which controls the first and second heads so that only the first head prints the contour of a character or a line image and at least the second head prints a portion of the character or the line image other than the contour, when a print image is the character or the line image.

Other aspects of the invention are apparent from the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
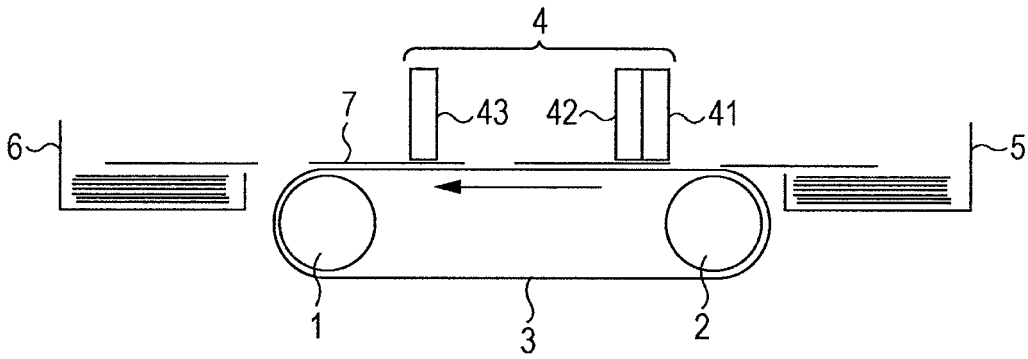
FIG. 1 is a front view illustrating the overall configuration of a printing apparatus according to an embodiment.

At least the following aspects are apparent from the description of the specification and the accompanying drawings.

According to an aspect of the invention, there is provided a printing apparatus including: a first head which has a plurality of nozzles arranged at a first pitch in a predetermined direction; a second head which has a plurality of nozzles arranged at a second pitch larger than the first pitch in the predetermined direction and which is spaced from the first head by a predetermined distance in a direction intersecting the predetermined direction; and a controller which controls the first and second heads so that only the first head prints the contour of a character or a line image and at least the second head prints a portion of the character or the line image other than the contour, when a print image is the character or the line image.

In the printing apparatus having the configuration, the first head may include first and second nozzle rows arranged in the predetermined direction, and the first pitch may be formed by the plurality of nozzles of the first nozzle row and the plurality of nozzles of the second nozzle row.

In the printing apparatus having the configuration, in a case where the print image is the character or the line image, the contour of the character or the line image may be printed by only the first nozzle row of the first head when pixels of the contour of the character or the line image are located at a position where the pixels are formed by the first nozzle row.

In the printing apparatus having the configuration, the second head, the first nozzle row, and the second nozzle row may be arranged such that an image of the print image oriented in the predetermined direction is printed sequentially by the first nozzle row, the second nozzle row, and the second head. The first nozzle row and the second nozzle row may be arranged at a predetermined interval L1 in the direction intersecting the predetermined direction, the second nozzle row and the second head may be arranged at a predetermined interval L2 in the direction intersecting the predetermined direction, and the intervals L1 and L2 may satisfy a relation of L2>L1.

In the printing apparatus having the configuration, the second nozzle row and the second head may be arranged so that the nozzles of the second nozzle row and the nozzles of the second head may not overlap with the nozzles of the first nozzle row in the predetermined direction.

In the printing apparatus having the configuration, the portion of the character or the line image other than the contour may be printed by at least one of the second nozzle row and the second head, when the nozzles of the second nozzle row and the nozzles of the second head overlap with each other in the predetermined direction.

In the printing apparatus having the configuration, the nozzles of the first head and the nozzles of the second head may eject the same color ink.

In the printing apparatus having the configuration, the controller may detect the contour of the character or the line image from the print image and permits the first head to print the contour of the character or the line image.

In the printing apparatus having the configuration, the width of the contour may be printed with at least one dot, when the contour of the character or the line image is printed by the first head.

In the printing apparatus having the configuration, the first head may be disposed on the upstream side of the second head in a transport direction of the print medium being transported in the direction intersecting the predetermined direction.

In the printing apparatus having the configuration, the first and second heads may include first and second heads for performing the printing with a first color and first and second heads for performing the printing with a second color. The first head for performing the printing with the first color, the first head for performing the printing with the second color, the second head for performing the printing with the first color, and the second head for performing the printing with the second color may be arranged in this order in the transport direction of the print medium transported in the direction intersecting the predetermined direction.

The printing apparatus having the configuration may further include a drying mechanism which accelerates the drying of ink and which is disposed between the first and second heads.

In the printing apparatus having the configuration, the first and second heads may include first and second heads for performing the printing with a first color and first and second heads for performing the printing with a second color. The first head for performing the printing with the first color, the second head for performing the printing with the first color, the first head for performing the printing with the second color, and the second head for performing the printing with the second color may be arranged in this order in the transport direction of the print medium transported in the direction intersecting the predetermined direction.

The printing apparatus having the configuration may further include a head unit which includes the first and second heads for each fluid ink color. The head units may be disposed so as to overlap with each other in the predetermined direction.

According to another aspect of the invention, there is provided a printing method performed by a printing apparatus including a first head which has a plurality of nozzles arranged at a first pitch in a predetermined direction and a second head which has a plurality of nozzles arranged at a second pitch larger than the first pitch in the predetermined direction. The printing method includes: detecting the contour of a character or a line image, when the character or the line image is printed; printing the detected contour by the first head; and printing a portion of the character or the line image other than the contour by the second head.

According to still another aspect of the invention, there is provided a program which controls a printing apparatus including a first head which has a plurality of nozzles arranged at a first pitch in a predetermined direction and a second head which has a plurality of nozzles arranged at a second pitch larger than the first pitch in the predetermined direction. The program causes a computer to execute: detecting the contour of a character or a line image from a print image; printing the detected contour by the first head; and printing a portion of the character or the line image other than the contour by the second head.

Embodiment

Hereinafter, an exemplary embodiment of the invention will be described with reference to the drawings.

Overall Configuration of Printing Apparatus

The overall configuration of a printing apparatus according to this embodiment will be described with reference to FIG. 1.

The printing apparatus according to this embodiment is a line printer shown in FIG. 1, for example. The printing apparatus includes transport rollers 1 and 2, a belt 3, a line head 4, a sheet supply unit 5, and a sheet discharge unit 6.

The transport rollers 1 and 2 are suspended on the belt 3. When a transport motor (not shown) rotates, the transport rollers 1 and 2 rotate and thus the belt 3 moves round. Therefore, a sheet 7 is transported on the belt 3. The line head 4 which performs printing by ejecting ink droplets onto the print sheet 7 being transported on the belt 3 is disposed at a predetermined position above the belt 3, as described below.

The sheet supply unit 5 disposed at one end of the belt 3 supplies the sheet 7 onto the belt 3 one by one. The sheet discharge unit 6 disposed at the other end of the belt 3 discharges the sheet 7 on which desired printing is completely performed by the lined head 4 while the sheet 7 is transported on the belt 3.

Configuration of Line Head

Figure 2:
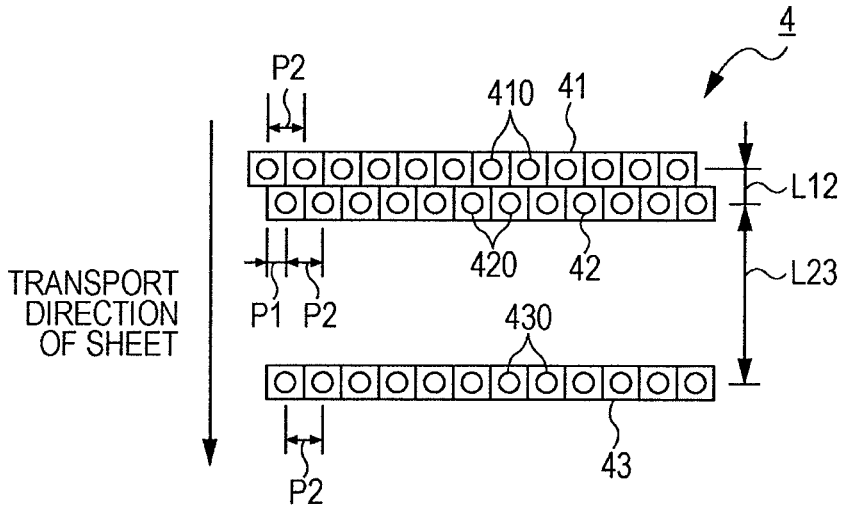
FIG. 2 is a plan view illustrating a configuration example of a line head.

FIG. 2 is a diagram illustrating a configuration example of the line head 4 shown in FIG. 1.

In the line head 4, a first row head 41, a second row head 42, and a third row head 43 are disposed in order at a predetermined interval in a transport direction of a sheet, as shown in FIGS. 1 and 2. The same ink is ejected from the nozzles of the first row head 41 to the nozzles of the third row head 43. For example, black ink is ejected.

The first row head 41 (corresponding to a first nozzle row) and the second row head 42 (corresponding to a second nozzle row) have a plurality of nozzles 410 and a plurality of nozzles 420, which are a print element ejecting ink, respectively, and constitute a first head. In the first head, the nozzles 410 and the nozzles 420 are alternately arranged at a pitch P1 in a direction (corresponding to a predetermined direction) intersecting the transport direction of the sheet. With such a configuration, printing can be performed with high density on the sheet 7.

The third row head 43 has a plurality of nozzles 430 as a printing element for ejecting ink and constitutes a second head. In the second head, the plurality of nozzles 430 are arranged at a pitch P2 (P2=2×P1) relatively larger than the pitch P1 in the direction intersecting the transport direction of the sheet. With such a configuration, the printing can be performed with density lower than that of the first head.

More specifically, the first row head 41 and the second row head 42 are arranged at a predetermined interval L12 in the transport direction of the sheet, as shown in FIG. 2. In the first row head 41, the plurality of nozzles 410 is arranged at a pitch P2 in the direction intersecting the transport direction of the sheet. In the second row head 42, the plurality of nozzles 420 is arranged at the pitch P2 in the direction intersecting the transport direction of the sheet. The nozzles 420 are deviated from the nozzles 410 by ½ of the pitch. Accordingly, the arrangement pitch of the nozzles 410 of the first row head 41 and the nozzles 420 of the second row head 42 is P1.

The second row head 42 and the third row head 43 are arranged at an interval L23 in the transport direction of the sheet, as shown in FIG. 2. The intervals L23 and L12 satisfy a relation of L23>L12.

The nozzles 430 of the third row head 43 are arranged at the pitch P2 in the direction intersecting the transport direction of the sheet, like the nozzles 420 of the second row head 42. The nozzles 430 of the third row head 43 are arranged so as to have the same phase as that of the nozzles 420 of the second row head 42 in the example of FIG. 2.

The nozzles 430 of the third row head 43 are arranged so as to have the same phase as that of the nozzles 410 of the first row head 41.

Here, when the nozzles 430 of the third row head 43 are arranged so as to have the same phase as that of the nozzles 420 of the second row head 42, the following advantages can be obtained. That is, dots on both sides of a dot formed by the first head 41 can be formed by the second row head 42 or the third row head 43. Since a distance between the first row head 41 and the third row head 43 is larger than a distance between the first row head 41 and the second row head 42, which results in giving more time to dry the landed ink, a greater amount of ink can be ejected.

Configuration of Control Processing System of Printing Apparatus

Next, the functional configuration of a control processing system of the printing apparatus according to this embodiment will be described with reference to FIG. 3.

The printing apparatus according to this embodiment controls the heads 41 to 43 so that the first row head 41 and the second row head 42 constituting a high density head print the contour of a character or a line image when a print image is the character or the line image and so that the third row head 43 constituting a low density head prints a portion other than the contour of the character or a portion other than the contour of the line image.

Figure 3:
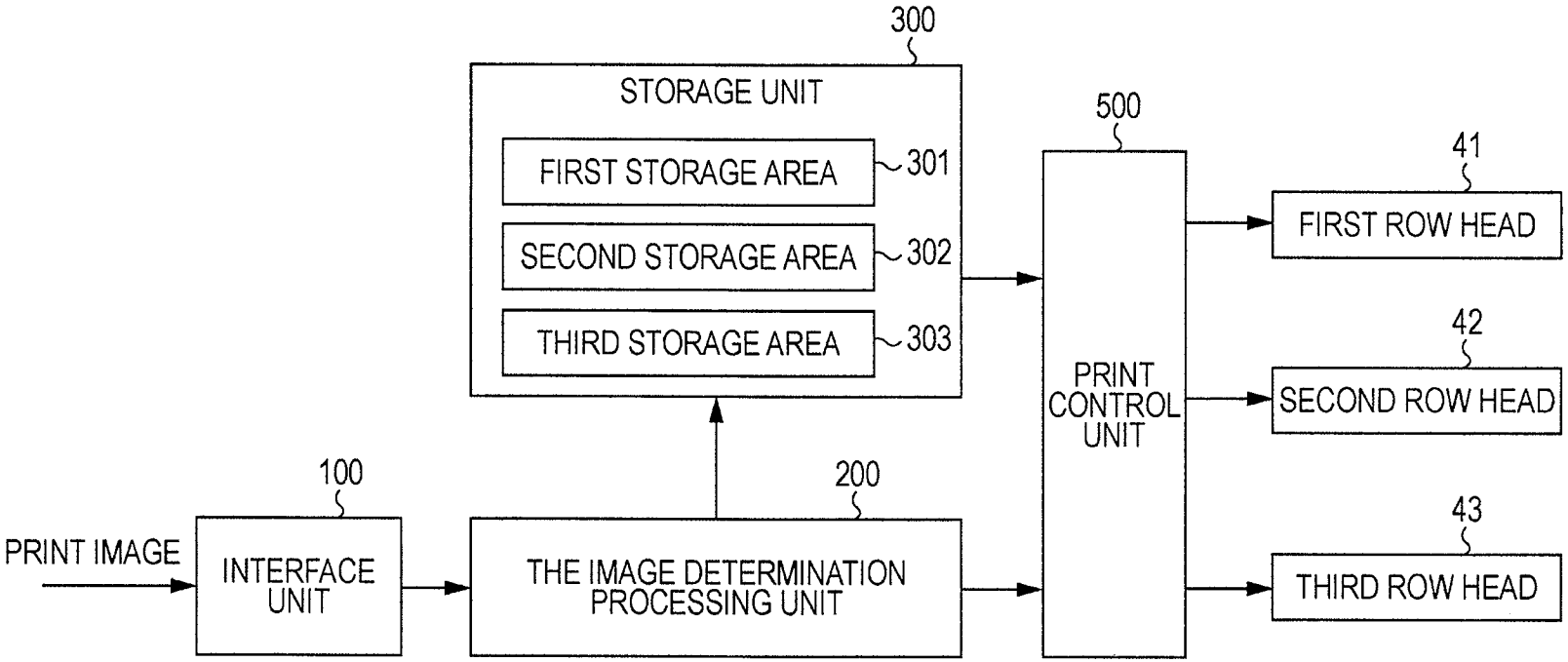
FIG. 3 is a block diagram illustrating a configuration example of a control processing system of the printing apparatus according to the embodiment.

The control processing system of the printing apparatus according to this embodiment includes an input interface unit 100, an image determination processing unit 200, a storage unit 300, and a print control unit 500, as shown in FIG. 3. The control processing system controls the printing (controls ejection of ink) of the heads 41 to 43.

Here, the print image which is printed by the printing apparatus according to this embodiment includes a character, and a line image (figure or the like). In this embodiment, the determination processing unit 200 is the constituent element of the printing apparatus, but is not necessarily the constituent element.

The input interface unit 100 acquires the print image from a computer or the like and outputs the acquired print image to the image determination processing unit 200.

The image determination processing unit 200 performs a determination process on the acquired print image, as described below, assigns printing to the heads 41 to 43 to all pixels in accordance with this determination, and generates print data (nozzle control data indicating whether to eject ink) used to eject the ink for every nozzles of the assigned heads. The generated print data are stored in the storage unit 300.

The image determination processing unit 200 includes a CPU, a RAM, and a ROM. The CPU executes the determination process, which is described below, in accordance with a program stored in advance in the ROM. Upon performing this determination process, the RAM is used as a work memory.

The storage unit 300 includes a first storage area 301, a second storage area 302, and a third storage area 303 and stores the print data generated in the image determination processing unit 200. The print data used to eject the ink from the nozzles 410 of the first row heads 41 are stored in the first storage area 301. The print data used to eject the ink from the nozzles 420 of the second row heads 42 are stored in the second storage area 302. The print data used to eject the ink from the nozzles 430 of the third row heads 43 are stored in the third storage area 303.

The print control unit 500 reads the print data stored in the storage unit 300 at predetermined time and controls the ejection of the ink from the nozzles 410 of the head 41, the nozzles 420 of the head 42, the nozzles 430 of the head 43 on the basis of the read print data.

Exemplary Determination Process

Figure 4:
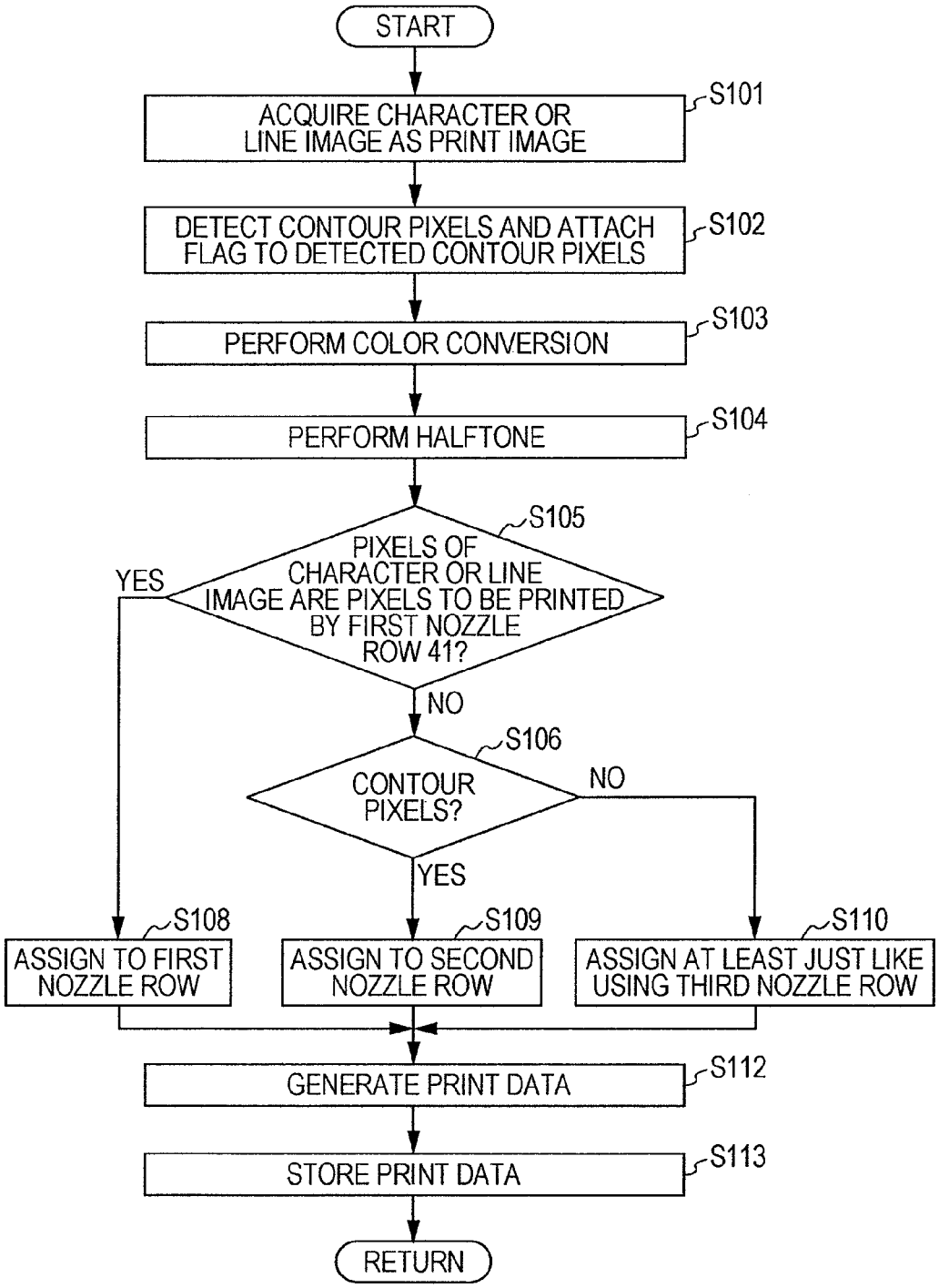
FIG. 4 is a flowchart for explaining an exemplary determination process.

Next, an exemplary determination process of the image determination processing unit 200 of the printing apparatus according to this embodiment will be described with reference to FIG. 4.

The outline of the determination process is as follows.

When the print image to be printed by the line head 4 is a character or a line image (figure or the like), the contour of the character or the line image is detected, the contour of the character or the line image is printed by the first row head 41 and the second row head 42, and the portion other than the contour is printed by the third row head 43.

Hereinafter, the exemplary determination process will be described in more detail.

In step S101, the line head 4 acquires a character or a line image (such as a figure), which is printed by the line head 4, as the print image.

In step S102, the pixel (contour pixel) of the contour of the acquired character or line image is detected in accordance with a predetermined rule and a flag is attached to the detected contour pixel. The reason for attaching the flag is to distinguish the contour from the portion (inside) other than the contour in the character or the line image.

Here, the contour pixel to which the flag is attached is at least one pixel. Alternatively, a plurality of the pixels (for example, the maximum five pixels) may be used.

In step S103, a color conversion process is performed. In this process, the data of the acquired print image is converted into the data of a CMKY format since the acquired print image has RGB image data. In step S104, a process associated with a halftone (middle tone) is performed. The reason for performing this process is to execute the binarization of the data.

Figure 5A:
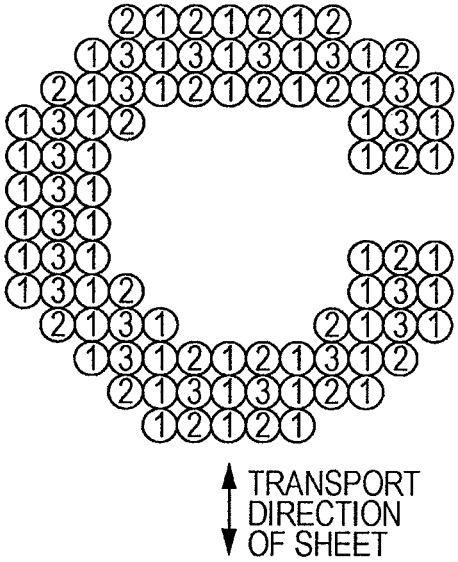
FIGS. 5A and 5B are diagrams illustrating examples of printing in accordance with the exemplary determination process.
Figure 5B:
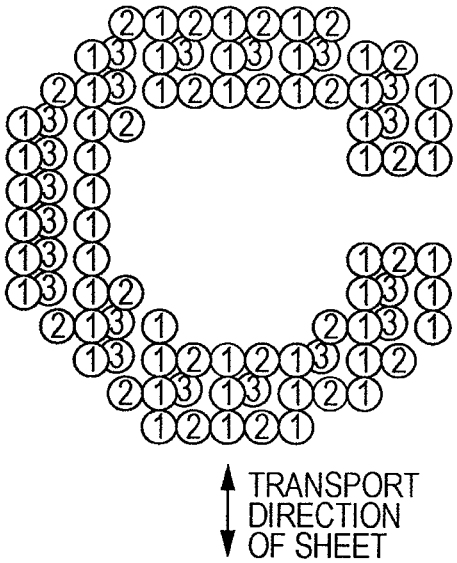

In step S105, it is determined whether the pixels of a printing target character or line image are the pixels located at the position where the printing can be printed by the first row head 41 (see FIGS. 5A and 5B).

When it is determined in step S105 that the pixels of the character or the line image are the pixels located at the position where the printing can be printed by the first row head 41, the process proceeds to step S108. Then, the printing of the contour pixels located at the position where the printing can be printed by the first row head 41 is assigned to the first row head 41. This is because the pitch of the first row head 41 is deviated from the pitch of the second row head 42 and the third row head 43 by the half of the pitch.

Alternatively, when it is determined in step S105 that the pixels of the character or the line image are not the pixels located at the position where the printing can be printed by the first row head 41, the process proceeds to step S106. In step S106, it is determined whether the pixels of the character or the line image are the contour pixels (see FIGS. 5A and 5B).

When it is determined in step S106 that the pixels of the character or the line image are the contour pixels, the process proceeds to step S109. In step S109, the printing of the contour pixel is assigned to the second row head 42 so that the printing is performed by the second row head 42.

Alternatively, when it is determined in step S106 that the pixels of the character or the line image are not the contour pixels, the process proceeds to step S110. In step S110, the printing of the pixels other than the contour pixels is assigned to at least one of the second row head 42 and the third row head 43 so that the printing is performed by at least one of the second row head 42 and the third row head 43.

In step S112, print data (nozzle control data representing whether to eject the ink) used to eject the ink from the nozzles of the heads 41 to 43 to which the printing is assigned are generated on the basis of the assignment of the heads 41 to 43 in steps S108 and S110.

In step S113, the generated print data are stored in the storage unit 300. The print data used to eject the ink from the nozzles 410 of the first row head 41 are stored in the first storage area 301. The print data used to eject the ink from the nozzles 420 of the second row head 42 are stored in the second storage area 302. The print data used to eject the ink from the nozzles 430 of the third row head 43 are stored in the third storage area 303.

The print control unit 500 reads the print data stored in the storage unit 300 at a predetermined time and controls the ejection of the ink from the nozzles 410 of the head 41 to the nozzles 430 of the head 43 on the basis of the read print data.

Example of Printing

FIGS. 5A and 5B are diagrams illustrating the examples of printing.

In FIGS. 5A and 5B, circles indicate dots formed by ejecting the ink from the nozzles 410 of the head 41, the nozzles 420 of the head 42, and the nozzles 430 of the head 43. In addition, Numeral "1" in the circles represents the dot formed by the nozzle 410, Numeral "2" in the circles represent the dot formed by the nozzle 420, and Numeral "3" in the circles represent the dot formed by the nozzle 430.

FIG. 5A shows a case where the position precision of the dots formed by ejecting the ink from the heads 41 and 42 and the dots formed by ejecting the ink from the head 43 is good. FIG. 5B shows a case where the position precision of the dots is poor.

Figure 11A:
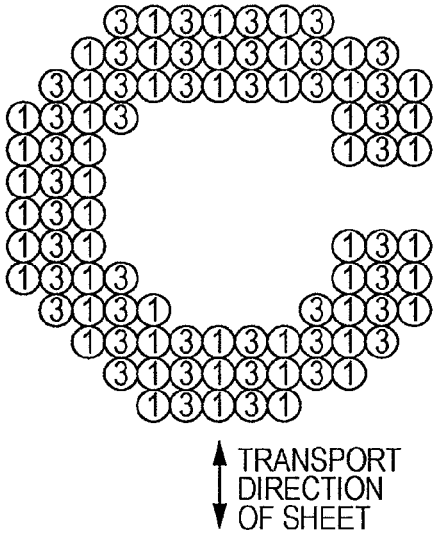
FIGS. 11A and 11B are diagrams illustrating examples of known printing by a known line head.
Figure 11B:
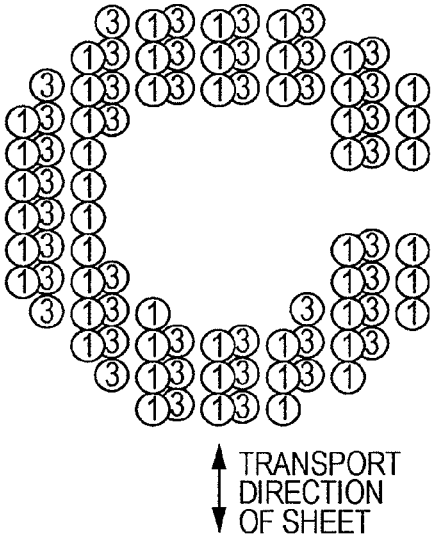

Comparing the example of the printing in FIGS. 5A and 5B to the example of the printing in FIGS. 11A and 11B, there is little difference between the print quality according to this embodiment and the print quality of the known technique when the position precision of the dots formed by ejecting the ink is good (see FIGS. 5A and 11A). However, even when the position precision of the dots formed by ejecting the ink is poor, deterioration in the print quality as in the known technique is not caused in this embodiment (see FIGS. 5B and 11B).

The position precision of the dots is influenced by the arrangement interval of the heads. Therefore, as the arrangement interval is smaller, the position precision of the dots improves.

In the example of the printing in FIGS. 5A and 5B, the printing of the pixels other than the contour pixels is assigned to the third row head 43. However, the printing of the pixels other than the contour pixels may be assigned to both the second row head 42 and the third row head 43.

Other Configurations of Line Head

Figure 6:
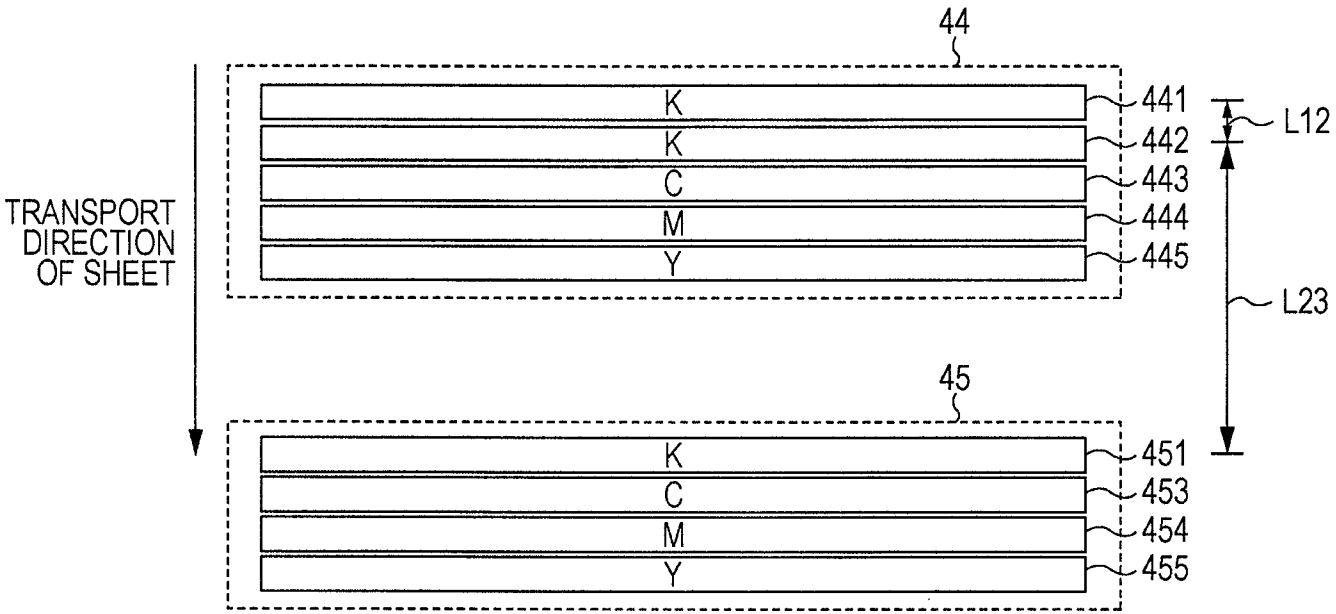
FIG. 6 is a plan view illustrating a first other example of the line head.
Figure 9:
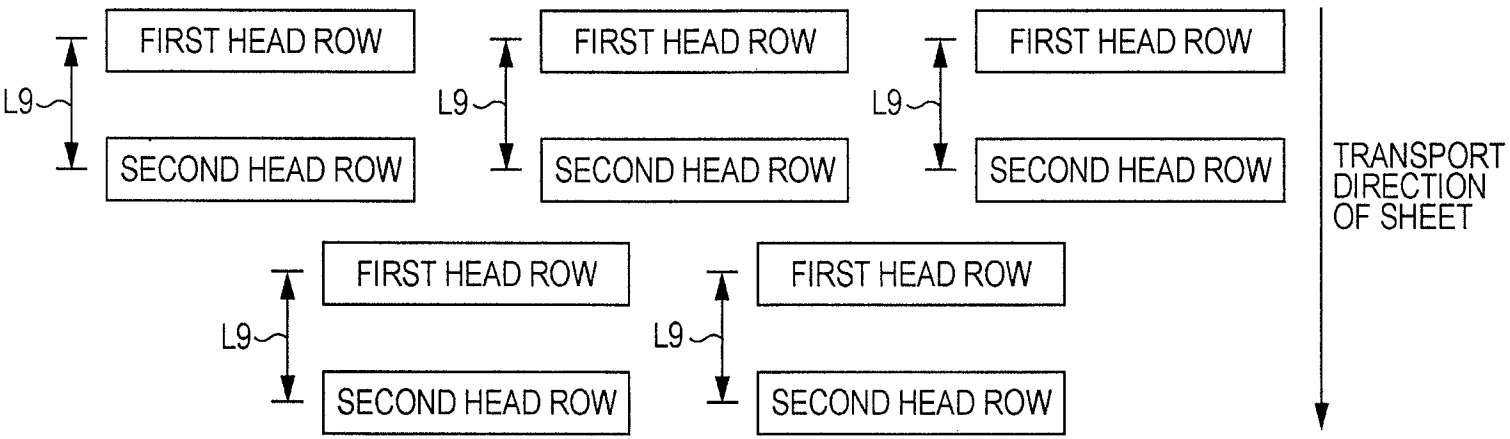
FIG. 9 is a plan view illustrating a fourth other example of the line head.
Figure 10:
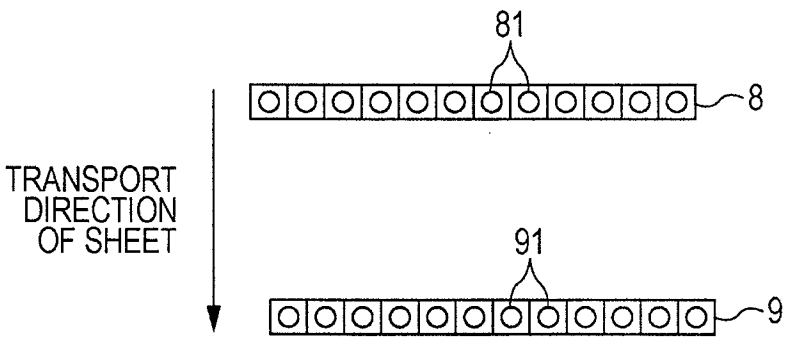
FIG. 10 is a plan view illustrating the configuration example of a known line head.

FIGS. 6 and 9 are diagrams illustrating other configuration examples of the line head.

(A) FIG. 6 shows a first other example of the line head.

In the first other example, as the line head capable of performing color printing of four colors, there are provided a first row head unit 44 and a second row head unit 45, which are arranged in parallel in the transport direction of the sheet at a predetermined interval.

The first row head unit 44 includes a head 441 and 442 which are continuously arranged and eject black (K) ink, a head 443 for ejecting cyan (C) ink, a head 444 for ejecting magenta (M) ink, and a head 445 for ejecting yellow (Y) ink. The heads 441 and 442 correspond to the first row head 41 and the second row head 42 shown in FIG. 2.

The second row head unit 45 includes a head 451 for ejecting black ink, a head 453 for ejecting cyan ink, a head 454 for ejecting magenta ink, and a head 455 for ejecting yellow ink. The heads 451 corresponds to the third row head 43 shown in FIG. 2.

With such a configuration, the arrangement density of the nozzles of the heads 441 and 442 is the double of the arrangement density of the nozzles of the head 451. By continuously arranging the heads 441 and 442, it is possible to improve the position precision of the heads.

Figure 7:
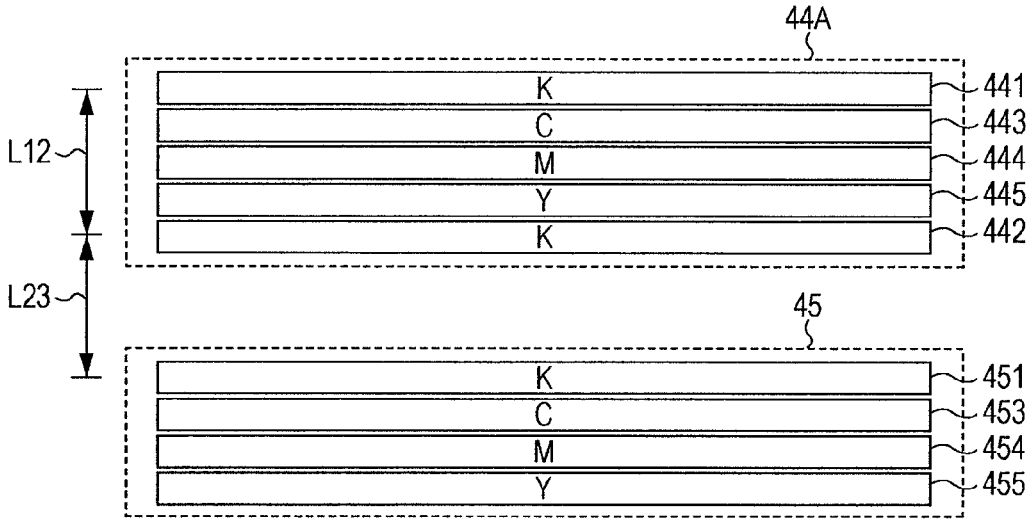
FIG. 7 is a plan view illustrating a second other example of the line head.

(B) FIG. 7 shows a second other example of the line head.

In the second other example, the first row head unit 44 in FIG. 6 is replaced by a first row head unit 44A. The configuration of the first row head unit 44A is different from the configuration of the first row head unit 44 in FIG. 6 in that the heads 441 and the 442 for ejecting the black ink are not continuously arranged but distant from each other.

In FIG. 7, since L12 and L23 satisfy a relation of L23>L12, it is possible to ensure the position precision of the ink dots without deteriorating the print density.

Figure 8:
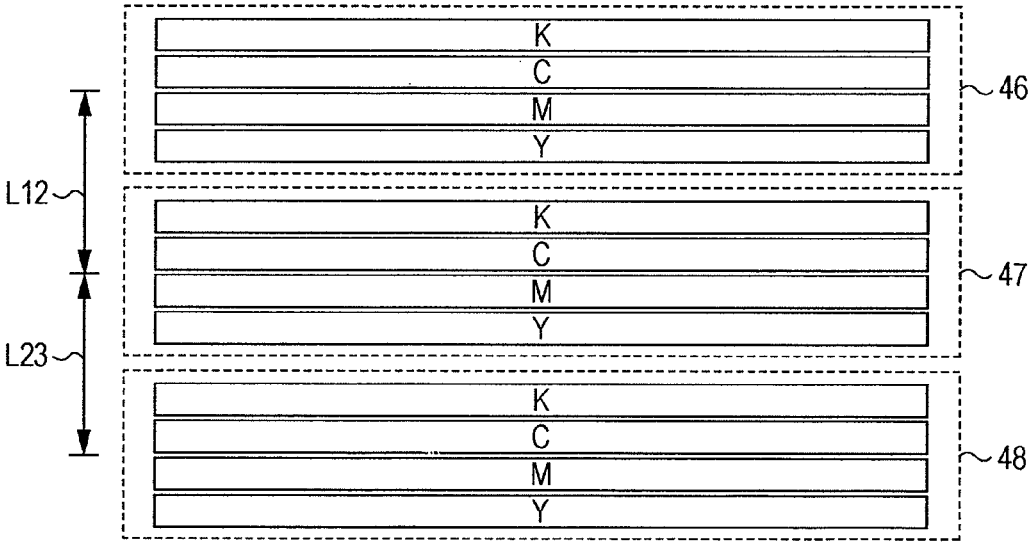
FIG. 8 is a plan view illustrating a third other example of the line head.

(C) FIG. 8 shows a third other example of the line head.

In the third other example, a line head capable of performing printing with four colors is constituted by a first row head unit 46, a second row head unit 47, and a third row head unit 48, which are arranged at a predetermined interval in the transport direction of the sheet.

The head units 46 to 48 each include a head for ejecting black (K) ink, a head for ejecting cyan (C) ink, a head for ejecting magenta (M) ink, and a head for ejecting yellow (Y) ink.

In the first row head unit 46 and the second row head unit 47, the nozzles thereof are arranged with high density. The arrangement of the nozzles of the respective colors is the same as the arrangement of the nozzles in the first row head 41 and the second row head 42 in FIG. 2.

The nozzles of each head in the third row head unit 48 are arranged so that the phase thereof is the same as the phase of the nozzles of each head in the first row head unit 46 or the second row head unit 47. The arrangement of the nozzles are the same as that of the nozzles of the third row head in FIG. 2 and as that of the nozzles of the first row head 41 or the nozzles of the second row head 42.

Each head of the first row head unit 46 and each head of the second row head unit 47 are arranged at a predetermined interval L12 in the transport direction of the sheet, as shown in FIG. 8. Each head of the second row head unit 47 and each head of the third row head unit 48 are arranged at a predetermined interval L23 in the transport direction of the sheet at the predetermined interval, as shown in FIG. 8. L12 and L23 are set so as to satisfy a relation of L23>L12.

In FIG. 8, since L12 and L23 also satisfy the relation of L23>L12, it is possible to ensure the position precision of the ink dots formed with the respective colors without deteriorating the print density of the respective color ink.

(D) FIG. 9 shows a fourth other example of the line head.

In the fourth other example, first head rows and second head rows are arranged at an interval L9 in the transport direction of the sheet. The head rows are arranged in zigzags in a direction intersecting the transport direction of the sheet. On the whole, the head rows form a line head. This embodiment is applicable to the printing apparatus having such a configuration of the line head.

In this embodiment, the contour of the character or the line image is printed by the head in which the arrangement density of the nozzles is high and the portion other than the contour is printed by the head in which the arrangement density of the nozzles is low. Accordingly, it is possible to ensure the position precision of the ink dots in the contour of the character or the line image even in high speed printing.

In this embodiment, among three heads, two heads constitute the head in which the arrangement density of the nozzles is high and one head constitutes the head in which the arrangement density of the nozzles is low. Accordingly, it is possible to reduce the difference in characteristics between the heads and ensure the position precision of the ink dots.

In this embodiment, as shown in FIG. 2, an image is printed in the direction intersecting the transport direction of the sheet at the pitch P1 by the heads 41 and 42, and then is printed at the pitch P2 by the head 43. The interval L21 at which the heads 41 and 42 are arranged is larger than the interval L23 at which the heads 42 and 43 are arranged. With such a configuration, since a period of time required to permeate ink into the print medium (a sheet or the like) in the contour or to dry the print medium can be ensured, it is possible to increase the amount of ink ejected in the portion other than the contour. Accordingly, it is possible to ensure the position precision of the ink dots and increase the print density.

In this embodiment, since the nozzles of the head in which the arrangement density of the nozzles is high and the nozzles of the head in which the arrangement density of the nozzles is low eject the same color ink, the printing of the character or the line image can be performed using the head in which the arrangement density of the nozzles is high and the head in which the arrangement density of the nozzles is low. Accordingly, it is possible to ensure the position precision of the ink dots while performing the high speed printing.

In this embodiment, the width of the contour is printed with at least one dot. Accordingly, when the contour of the character or the line image is printed, the width of the contour can be changed.

Figure 12:
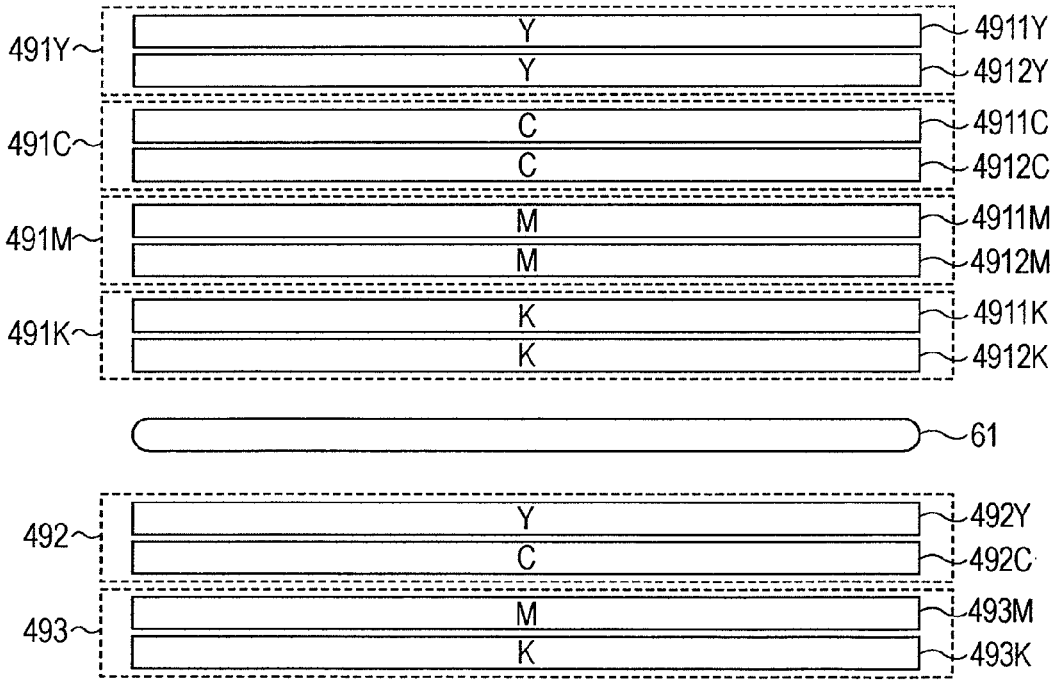
FIG. 12 is a plan view illustrating a fifth other example of the line head.

FIG. 12 is a plan view illustrating a fifth other example of the line head. In the fifth other example, a first row head and a second row head constitute one head unit for every ink color to be ejected. For example, a first row head 4911Y and a second row head 4912Y for yellow ink, which are closely arranged, constitute one head unit 491Y. Likewise, head units 491C, 491M, and 491K are organized for cyan ink, magenta ink, yellow ink, and black ink, respectively. In the fifth other example, the head units are arranged in order of yellow ink, cyan ink, magenta ink, and black ink from the upstream side in the transport direction of the sheet. The arrangement order of the head units is not limited to this order.

In the fifth other example, the third row head is spaced from the first row head and the second row head of each ink color to the downstream side in the transport direction of the sheet. Here, the third row head 492Y for yellow ink and the third row head 492C for cyan ink constitute one head unit 492. The third row head 493M for magenta ink and the third row head 493K for black ink constitute one head unit 493. The head unit 492, which includes the third row head 492Y for yellow ink and the third row head 492C for cyan ink, is disposed on the upstream side of the head unit 493, which includes the third head 493M for magenta ink and the third row head 493K for black ink, in the transport direction of the sheet.

A drying mechanism 61 for accelerating the drying of the ink may be disposed between the head unit including the first row head and the second row head and the head unit including the third row head. The drying mechanism 61 may be an apparatus such as a metal halide lamp or an LED for radiating ultraviolet rays, when the ink is ultraviolet curing ink (UV ink), for example. Alternatively, there may be provided a blowing mechanism for blowing wind to dry the ink. Alternatively, there may be provided a heating mechanism for accelerating the drying of the ink.

Even when the drying mechanism 61 is provided in this way, the first row head and the second row head for forming the contour constitute one head unit. Accordingly, in the fifth other example, only one drying mechanism 61 may be disposed between the head unit included in the first row head and the second row head and the head unit included in the third row head. Accordingly, an advantage is obtained in that a plurality of the drying mechanisms is not necessary.

Figure 13:
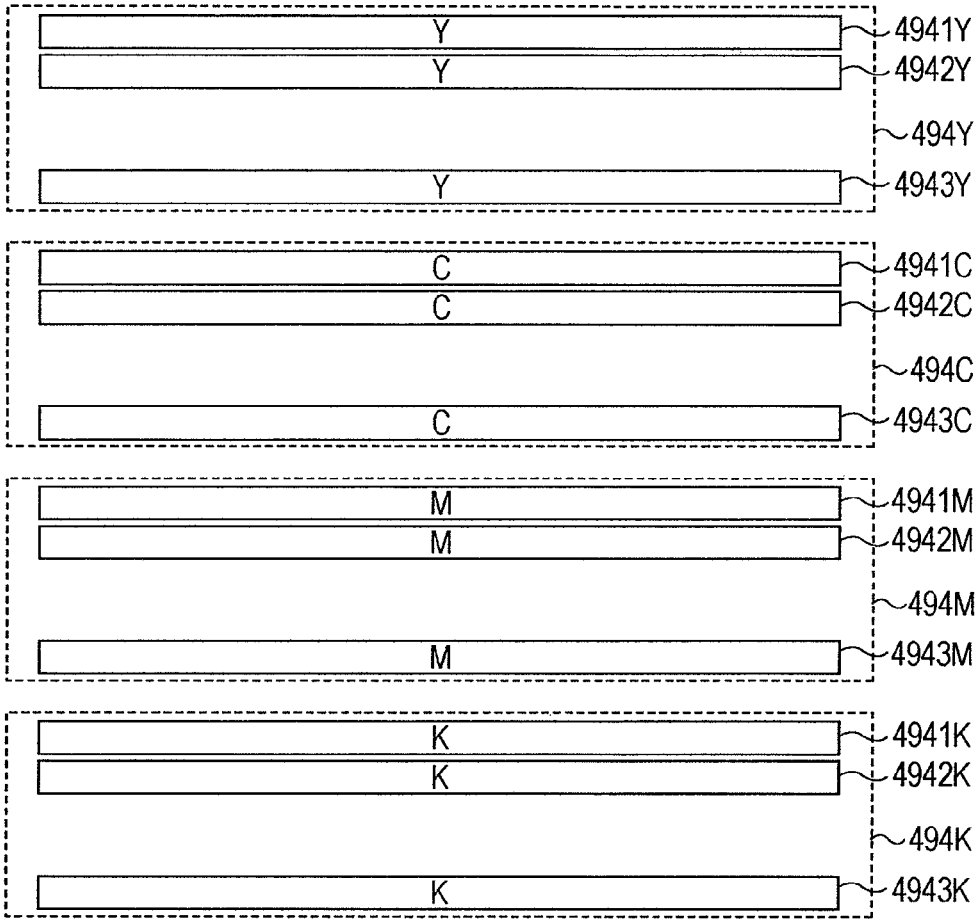
FIG. 13 is a plan view illustrating a sixth other example of the line head.

FIG. 13 is a plan view illustrating a sixth other example of the line head. In the sixth other example, a first row head, a second row head, and a third row head constitute one head unit for every ink color. For example, a first row head 4941Y, a second row head 4942Y, and a third row head 4943Y for yellow ink constitute one head unit 494Y. In the head unit, the first row head 4941Y and the second row head 4942Y are disposed so as to be close to each other in the transport direction of the sheet, whereas the third row head 4943Y is disposed so as to be distant from the first row head 4941Y and the second row head 4942Y in the transport direction of the sheet.

In the sixth other example, the head units are arranged in order of yellow ink, cyan ink, magenta ink, and black ink from the upstream side in the transport direction of the sheet. The arrangement order of the head units is not limited to this order.

In the configuration of each head unit constituted by the first, second, and third row heads, each ink can be landed to form the portion other than the contour of the character or the like after the contour is formed. That is, since the order of landing the ink can normally be made the same, it is possible to improve color uniformity.

In this embodiment, four colors, cyan, magenta, yellow, and black have been used as the ink colors. However, ink with low density may be added to lower granularity. In order to increase the color gamut, ink such as orange or green different from the four colors may be added. Alternatively, in order to improve gloss or improve a friction-resistant property of a printing unit, achromatic color ink may be added. Moreover, a head for ejecting only mono-color ink for white-and-black printing may be used.

Modified Examples (1) In the above-described embodiment, the width of the contour which is printed by the first row head 41 or the second row head 42 is formed with one dot. However, the width of the contour may be formed with a plurality of dots. Accordingly, the width of the contour is formed with at least one dot.

(2) In the above-described embodiment, the ink is landed onto the sheet 7, but any medium (print medium) onto which ink can be landed can be used. Accordingly, in printing performed by a print medium such as cloth, it is possible to ensure position precision of dots.

(3) In the above-described embodiment, the relative position of the line head 4 and the print medium is changed by transporting the sheet 7. However, any one of the line head 4 and the sheet 7 may be moved, as long as the relative position of the line head 4 and the print medium is changed. The line head 4 may be moved relative to the print medium to correspond to a change in the relative position by the transport of the sheet as in the above-described embodiment. Alternatively, both the line head 4 and the print medium may be moved.

(4) In the above-described embodiment, the program associated with the determination process has been executed in the determination processing unit 200. However, the program may be executed by a computer. In this case, the program is supplied in a form stored in a computer readable record medium. As such a record medium, there are used a variety of computer readable mediums such as a flexible disk, a CD-ROM, a magneto-optical disk, an IC card, a ROM cartridge, a punch card, a printing product in which signs such as barcode is printed, an internal storage device (a memory such as a RAM or a ROM) of a computer, and an external storage device of a computer.

(5) In the above-described embodiment, the input interface unit 100, the image determination processing unit 200, the storage unit 300, and the print control unit 500 are included in the printing apparatus, but the functions thereof may be realized in an image control apparatus such as a personal computer (PC) or a server. Likewise, steps S101 to S113 in FIG. 4 are executed in the printer, but step S101 to any one step or steps S101 to S113 may be executed by the image control apparatus.

(6) In the above-described embodiment, for example, the circles in FIGS. 5A and 5B indicate the dots formed by ejecting the ink from the nozzles 410 of the head 41 to the nozzles 430 to the head 43. However, one dot may be formed by one nozzle or one dot may be formed by two or more nozzles.

(7) In the above-described embodiment, the pitch of the nozzles 420 of the second row head 42 in FIG. 2 is the same as the pitch of the nozzles 430 of the third row head 43. However, the pitch of the nozzles 410 of the first row head 41 is the same as the pitch of the nozzles 430 of the third row head 43. In this case, it is determined in step S105 of FIG. 4 that the pixels of the character or the line image are the pixels to be printed by the second row head 42. In step S106, it is determined whether the pixels are the contour pixels. When it is determined that the pixels are the contour pixels, the printing is performed by the first row head 41. Alternatively, when it is determined that the pixels are not the contour pixels, the first row head 41 and the third row head 43 are selectively used.

(8) In the above-described embodiment, the pitch P1 is formed by the second row head and the pitch P2 is formed by the first row head. The pitch P2 is the double of the pitch P1. The nozzles 410 are arranged so that the phase thereof is deviated from that of the nozzles 420 and the nozzles 430 by ½ pitch. The pitch which is the same as the pitch P2 of the low density may be included in the pitch P1 of the high density. Accordingly, for example, the pitch P1 may be formed by the fifth row head and the pitch P2 may be formed by the third row head.

(9) The invention is not limited to the above-described embodiment, but may be modified in various forms without departing from the gist of the invention.

The entire disclosure of Japanese Patent Application No. 2008-303764, filed Nov. 28, 2008 is expressly incorporated by reference herein.

What is claimed is:

1. A printing apparatus comprising:

a first head which has a plurality of nozzles each arranged in a first nozzle row and a second nozzle row, each nozzle of the second nozzle row being offset with respect to an adjacent nozzle of the first row at a first pitch in a predetermined direction, the first nozzle row having a first phase and the second nozzle row having a second phase, where phase is the alignment of a nozzle row in the predetermined direction;

a second head which has a plurality of nozzles each arranged with respect to each other at a second pitch larger than the first pitch in the predetermined direction and which said second head is spaced from the first head by a predetermined distance in a direction intersecting the predetermined direction, the nozzles of the second head having a phase equal to one of the first phase and the second phase; and a controller which controls the first and second heads so that only the first head prints the contour of a character or a line image and at least the second head prints a portion of the character or the line image other than the contour, when a print image is the character or the line image.

2. The printing apparatus according to claim 1, wherein in a case where the print image is the character or the line image, the contour of the character or the line image is printed by only the first nozzle row of the first head when pixels of the contour of the character or the line image are located at a position where the pixels are formed by the first nozzle row.

3. The printing apparatus according to claim 1, wherein the second head, the first nozzle row, and the second nozzle row are arranged such that an image of the print image oriented in the predetermined direction is printed sequentially by the first nozzle row, the second nozzle row, and the second head, and wherein the first nozzle row and the second nozzle row are arranged at a predetermined interval L1 in the direction intersecting the predetermined direction, the second nozzle row and the second head are arranged at a predetermined interval L2 in the direction intersecting the predetermined direction, and the intervals L1 and L2 satisfy a relation of L2>L1.

4. The printing apparatus according to claim 1, wherein the second nozzle row and the second head are arranged so that the nozzles of the second nozzle row and the nozzles of the second head do not overlap with the nozzles of the first nozzle row in the predetermined direction.

5. The printing apparatus according to claim 1, wherein the portion of the character or the line image other than the contour is printed by at least one of the second nozzle row and the second head, when the nozzles of the second nozzle row and the nozzles of the second head overlap with each other in the predetermined direction.

6. The printing apparatus according to claim 1, wherein the nozzles of the first head and the nozzles of the second head eject the same color ink.

7. The printing apparatus according to claim 1, wherein the controller detects the contour of the character or the line image from the print image and permits the first head to print the contour of the character or the line image.

8. The printing apparatus according to claim 1, wherein the width of the contour is printed with at least one dot, when the contour of the character or the line image is printed by the first head.

9. The printing apparatus according to claim 1, wherein the first head is disposed on the upstream side of the second head in a transport direction of the print medium being transported in the direction intersecting the predetermined direction.

10. The printing apparatus according to claim 1, wherein the first and second heads include first and second heads for performing the printing with a first color and first and second heads for performing the printing with a second color, and wherein the first head for performing the printing with the first color, the first head for performing the printing with the second color, the second head for performing the printing with the first color, and the second head for performing the printing with the second color are arranged in this order in the transport direction of the print medium transported in the direction intersecting the predetermined direction.

11. The printing apparatus according to claim 1, further comprising a drying mechanism which accelerates the drying of ink and which is disposed between the first and second heads.

12. The printing apparatus according to claim 1, wherein the first and second heads include first and second heads for performing the printing with a first color and first and second heads for performing the printing with a second color, and wherein the first head for performing the printing with the first color, the second head for performing the printing with the first color, the first head for performing the printing with the second color, and the second head for performing the printing with the second color are arranged in this order in the transport direction of the print medium transported in the direction intersecting the predetermined direction.

13. The printing apparatus according to claim 12, further comprising:

a head unit which includes the first and second heads for each fluid ink color, wherein the head units are disposed so as to overlap with each other in the predetermined direction.

* * * * *